US005339072A

United States Patent [19]

Agata

[11] Patent Number: 5,339,072

[45] Date of Patent: Aug. 16, 1994

[54] FIRE DETECTOR WITH ANTI-TAMPERING MEASURES FOR USE IN VEHICLES

[75] Inventor: Masanobu Agata, Tokyo, Japan

[73] Assignee: Nohmi Bosai, Ltd, Tokyo, Japan

[21] Appl. No.: 980,559

[22] Filed: Nov. 23, 1992

[30] Foreign Application Priority Data

Dec. 9, 1991 [JP] Japan ..... 3-324694
Dec. 9, 1991 [JP] Japan ..... 3-324695

[51] Int. Cl.[5] ..... G08B 17/00

[52] U.S. Cl. ..... 340/693; 340/628; 340/438; 340/945

[58] Field of Search ..... 340/693, 628, 629, 630, 340/945, 438

[56] References Cited

U.S. PATENT DOCUMENTS

| | | | |
|---|---|---|---|
| 3,959,788 | 5/1976 | Tipton et al. | 340/629 |
| 4,092,641 | 5/1978 | Bellinghausen et al. | 340/628 |
| 4,238,679 | 12/1980 | Macmillan et al. | 250/385.1 |
| 4,529,976 | 7/1985 | Jameson et al. | 340/628 |
| 4,630,037 | 12/1986 | Escamilla, Jr. | 340/628 |
| 4,740,703 | 4/1988 | Inamura | 250/385.1 |
| 4,853,544 | 8/1989 | Inamura | 250/385.1 |

*Primary Examiner*—Glen R. Swann, III

*Attorney, Agent, or Firm*—Wenderoth, Lind & Ponack

[57] ABSTRACT

A fire detector installed in a low ceiling surface of a vehicle such as an aircraft or train is equipped with an antitampering measure for preventing tampering such as covering the exposed portion of the fire detector with a paper cup or a vinyl bag or such as by sticking chewing gum or tissue paper in the smoke inlet portions thereof. Such tampering is usually carried out by passengers trying to sneak a smoke in a non-smoking area. The fire detector includes a main body having a head portion for letting in combustion products and a fire detection portion for performing fire detection on the basis of the combustion products let in from the head portion, and a mounting portion containing most of the main body and provided with a central opening portion for allowing the head portion to protrude from the ceiling surface so as to perform fire monitoring. The detector is further provided with a plurality of fins around the central opening portion of the mounting portion as an antitampering measure, each fin having a high portion with a height equal to or higher than that of the head portion protruding from the mounting portion and a spreading portion that gradually decreases in height with distance away from the main body.

16 Claims, 7 Drawing Sheets

FIRE DETECTOR WITH ANTI-TAMPERING MEASURES FOR USE IN VEHICLES

BACKGROUND OF THE INVENTION

1. Field of the Invention

The present invention relates to fire detectors installed in vehicles such as aircraft or trains, and especially to such a fire detector equipped with an anti-tampering measures.

2. Description of the Prior Art

In compartments of vehicles such as passenger compartments, toilets or lavatories, the heights from the floors to the ceilings thereof are generally small so there is not sufficient room for installing a fire detector. Accordingly, fire detectors provided in vehicles are generally installed in the ceiling surface of a vehicle such that most of the generally cylindrical or rectangular body of the fire detector is put into a portion above the ceiling surface and only those portions essential for fire detection such as a smoke inlet is exposed to the inside of the vehicle compartment.

To this end, the fire detector comprises a main body having a fire-detection portion and a mounting portion for mounting the main body on the ceiling surface.

As such fire detectors installed on vehicles are mounted in the low ceiling surface of various compartments as explained above, there has been frequent tampering of the fire detector, for example, covering the exposed portion of the detector body inside of compartment with paper cups or vinyl bags, etc.

Fire detectors can not detect fire phenomena such as smoke, etc., if such tampering occurs, which can lead to serious problems when a fire occurs that can not be detected during flight, movement, etc.

FIGS. 1 and 2 show a conventional fire detector 12 similar to smoke detectors currently installed on such as ceiling surface 10 of a vehicle such as an aircraft. The fire detector 12 includes a main body 14 having an ionization type fire detection portion with a structure disclosed in U.S. Pat. Nos. 4,740,703 and 4,853,544, for example, and a mounting portion 16 for mounting this main body 14 on the ceiling surface 10. The mounting portion 16 has a receiving portion **16*a* receiving most of the main body 14 and a surface portion 16*b* facing the interior of a compartment, with the main body 14 being fixed to the bottom of the receiving portion 16*a* by screws 18. One part of the main body 14, i.e. a head portion 14*a*, protrudes from a central opening portion 16*c* of the surface portion 16*b* to the compartment interior side whereby inlet portions 14*b* of the main body 14 can draw in smoke, etc., from the compartment in order to perform fire detection. The inlet portions 14*b* are provided both at the side faces of the head portion 14*a* as shown in FIG. 1 and on the surface thereof as shown in FIG. 2, so that both sets of inlet portions 14*b* can let in smoke. In order to explain one embodiment of the present invention, the head portion 14*a* is shown generally in the form of a regular square in a plane view shown in FIG. 2, the length of one side of the regular square being 39 mm, with the length of the diagonal line thereof accordingly being about 55 mm. The mounting portion 16 itself is fixed to the ceiling surface 10 by screws 20, and the main body 14 has a cable 22 connected thereto including a power supply line for supplying the main body 14 with power and a signal line for transimitting a fire detecting signal, etc., from the main body 14** to a fire control panel, etc., not shown.

As vehicle's users or passengers can easily reach the low ceiling surface of the vehicle, there has been fire detector tampering such as shown in FIGS. 1 and 2 such as covering it with a paper or polyethylene cups, etc., sticking chewing gum or tissue paper on the smoke inlet portions of the fire detector, or covering the portion of the main body of the fire detector exposed to the interior of the compartment with a vinyl bag. Such tampering is performed by passengers trying to sneak a smoke such as during a non-smoking flight. If the fire detector is an ionization type or photoelectric type (light scattering type) smoke detector, for example, its normal smoke detecting faculty will be ruined by such tampering.

Actually, many of the disturbances to a fire detector's faculty arise from being covered with a paper cup. Coincidentally, in some small-mouthed paper cups, for example, the inside diameter of their mouth edge are approximately coincident with the length of the diagonal of the head portion **14*a* of the main body 14 of the fire detector, as shown by dotted line L1 in FIG. 2. Such small-mouthed paper cups can completely cover the head portion 14*a* of the fire detector as shown by a dotted line C in FIG. 1. If a smoker has smoked while keeping such a small-mouthed paper cup C on the head portion 14*a*** of the fire detector and has forgotten to remove the paper cup from its position, the fire detector can not detect fire phenomenon arising from smoke, etc., which can lead to a catastrophe when a fire occurs, especially during flying, running, etc.

FIGS. 3 and 4 show another conventional fire detector 112 such as a smoke detector installed in a ceiling surface 10, etc. of a vehicle. This detector 112 differs from the detector shown in FIGS. 1 and 2 in that a stepped portion **116*d* is provided around a central opening portion 116*c* of a surface portion 116*b* of a mounting portion 116 surrounding a head portion 114*a* of a main body 114 to enhance the inflow of smoke. As the other elements in FIGS. 3 and 4 are similar to the ones shown in FIGS. 1 and 2, they are indicated by numerals similar to those in FIGS. 1 end 2 but increased by 100**.

In such a fire detector 11 2, there also occurs a problem in that the small-mouthed paper cups can be inserted entirely into the stepped portion **116*d* as shown by a dotted line L13 in FIG. 4** when the mouth edge of the paper cup is deformed in the form of a square.

SUMMARY OF THE INVENTION

In light of the above, it is an object of the present invention to obtain a fire detector that can be safe from tampering such as covering the fire detector with a paper cup or a vinyl bag.

Accordingly, the present invention provides countermeasures against disturbances to the fire detection faculty caused by tampering. In devising the countermeasures, the following points were taken into account:

Point 1: Preventing the coverage of the head portion **14*a*** of the fire detector with small-mouth paper cups;

Point 2: Taking normal type large-mouthed paper cups (the inside diameter thereof shown by dotted line L2 in FIG. 2) into consideration when devising a countermeasure against small-mouthed type paper cups in Point 1;

Point 3: Making it difficult to stick chewing gum or tissue paper, etc., into the smoke inlet portions 14b of the fire detector head portion 14a;

Point 4: Preventing small-mouthed type paper cups from being inserted into the stepped portion 116d.

In consideration of the above, the present invention provides a fire detector equipped in a vehicle such as an aircraft comprising: a main body having a head portion for letting in combustion products and a fire detection portion for performing fire detection on the basis of the combustion products let in from said head portion; and a mounting portion containing most of said main body and provided with a central opening portion for allowing said head portion to protrude in order to perform fire monitoring; wherein said fire detector further comprises blocking means around said central opening portion of said mounting portion for preventing paper cups, etc., from being mounted on said head portion of said fire detector, said blocking means having a height approximately equal to or higher than that of said head portion protruding from said central opening portion, the height thereof decreasing with distance away from said head portion.

BRIEF DESCRIPTION OF THE DRAWINGS

The invention will now be described with reference to the accompanying drawings wherein.

DESCRIPTION OF THE PREFERRED EMBODIMENT

Figure 1:
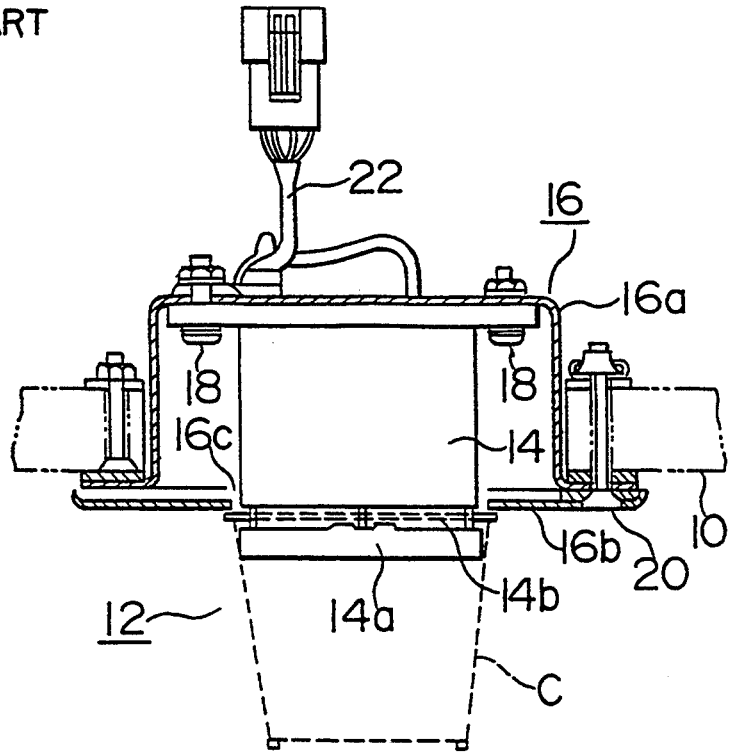
FIG. 1 PRIOR ART
FIG. 1 is a vertical sectional view showing a conventional fire detector currently installed in some vehicles.

Referring now to the drawings, the present invention will be explained below.

Figure 2:
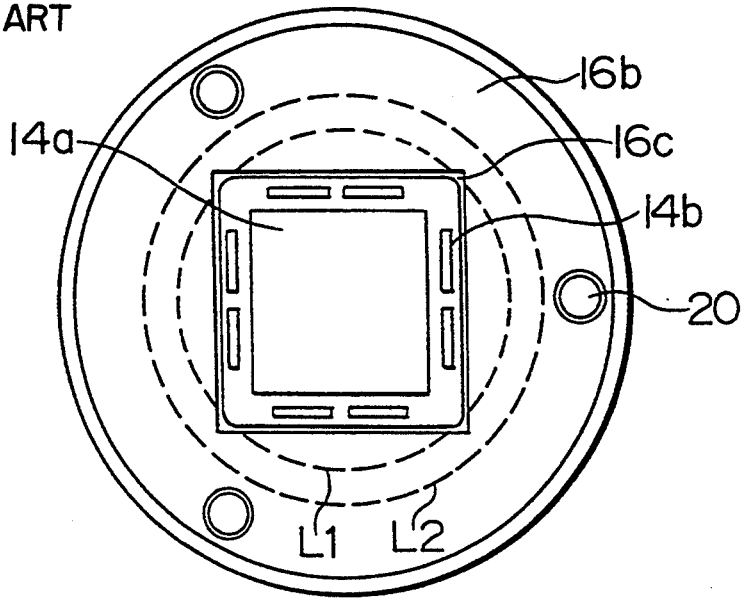
FIG. 2 PRIOR ART
FIG. 2 is a bottom plane view of FIG. 1.
Figure 5:
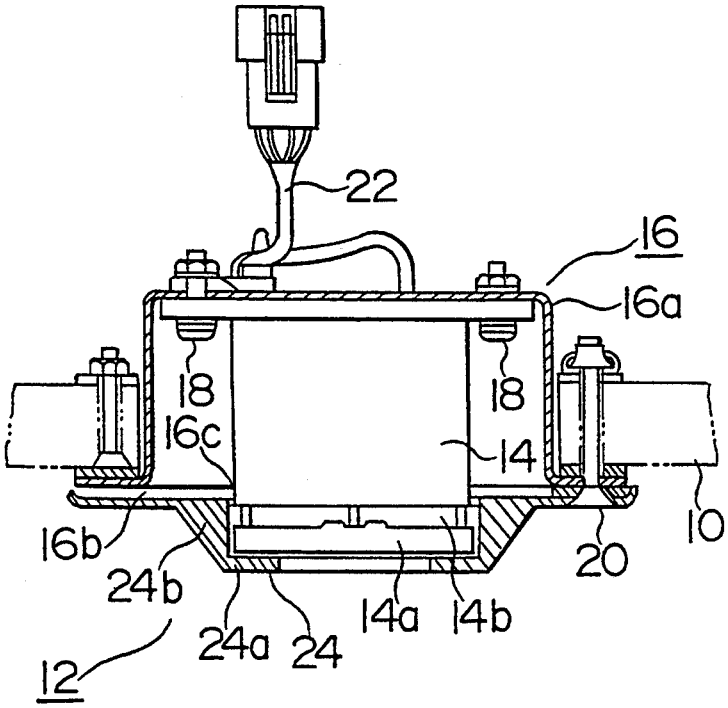
FIG. 5 is a vertical sectional view showing a fire detector according to one embodiment of the present invention, having countermeasures against tampering of the fire detector shown in FIGS. 1 and 2.
Figure 6:
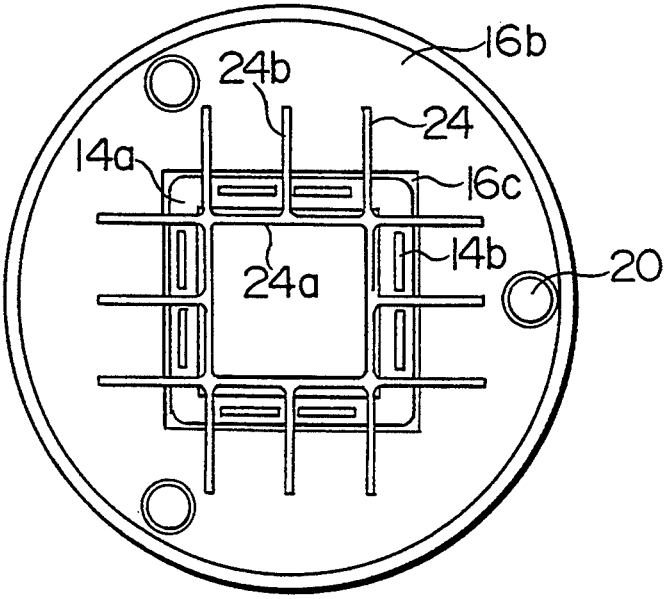
FIG. 6 is a bottom plane view of FIG. 5.

FIGS. 5 and 6 show the fire detector according to one embodiment of the present invention, having the above countermeasures against a tampering with the fire detector shown in FIGS. 1 and 2. In FIGS. 5 and 6, the same numerals are used for like parts shown in FIGS. 1 and 2, the explanation thereof being omitted. The surface portion 16b of the mounting portion 16 of the fire detector 12 has a fin arrangement 24 formed integrally thereto. The fin arrangement 24 has a structure such that a portion of the fin arrangement 24 overlies the head portion 14a of the main body 14 as shown in FIG. 6 when the surface portion 16b of the mounting portion 16 is attached to the mounting portion 16 after the main body 14 is mounted into the containing portion 16a of the mounting portion 16.

As seen from FIG. 5, each of fins in the fin arrangement 24 includes a portion 24a higher than and overlying the head portion 14a, and a spreading portion 24b gradually decreasing in height from the overlying portion 24a higher than the head portion 14a. The existance of the overlying portions 24a makes it impossible to put small-mouthed type paper cups over the head portion 14a, while the spreaded portions 24b extend long enough beyond the mouth edge of normal type large-mouthed paper cups to make it impossible to put them on the ends of the spreading portions 24b remote from the head portion 14a. Also, the constitution shown in FIGS. 5 and 6 makes it very difficult to stick chewing gum, tissue paper, vinyl bags, etc., on the inlet portions 14b because the fin arrangement 24 prevents this.

Also, for conventional fire detectors that have already been installed, the present invention can be easily applied by merely replacing the surface portion 16b of the mounting portion 16 with the surface portion 16b to which the fin arrangement 24 is integrally formed.

Although the spreading portions 24b, in FIGS. 5 and 6, were described as extending far enough beyond the mouth edge of normal type paper cups, conversely, the far ends of the spreading portions 24b may also be inside the mouth edge of such cups so that they can not be fitted on the spreading portions 24b. What is essential is that the far ends of the spreading portions 24b not coincide with the mouth edge of normal type paper cups so that engagement between the far ends of the spreading portions 24b and the mouth edge of such paper cups is prevented.

Figure 3:
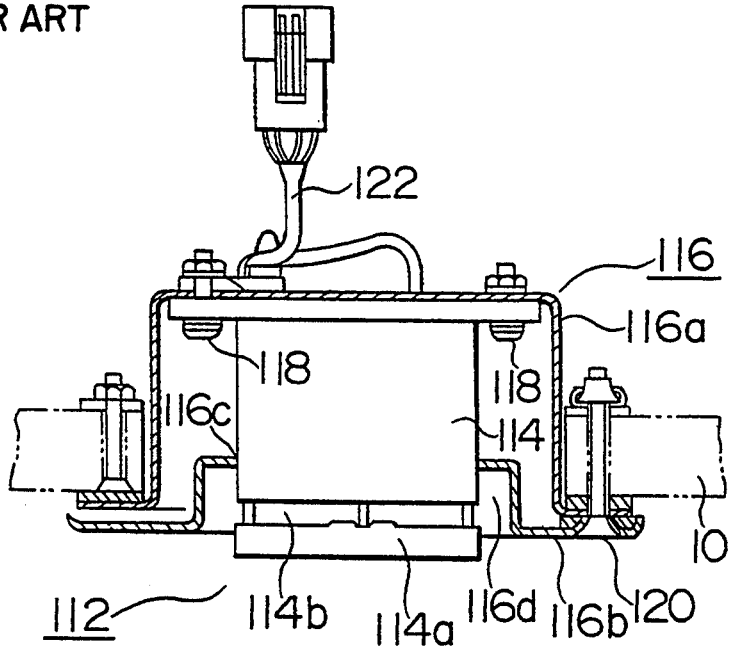
FIG. 3 PRIOR ART
FIG. 3 is a vertical sectional view showing another conventional fire detector currently installed in some vehicles.
Figure 4:
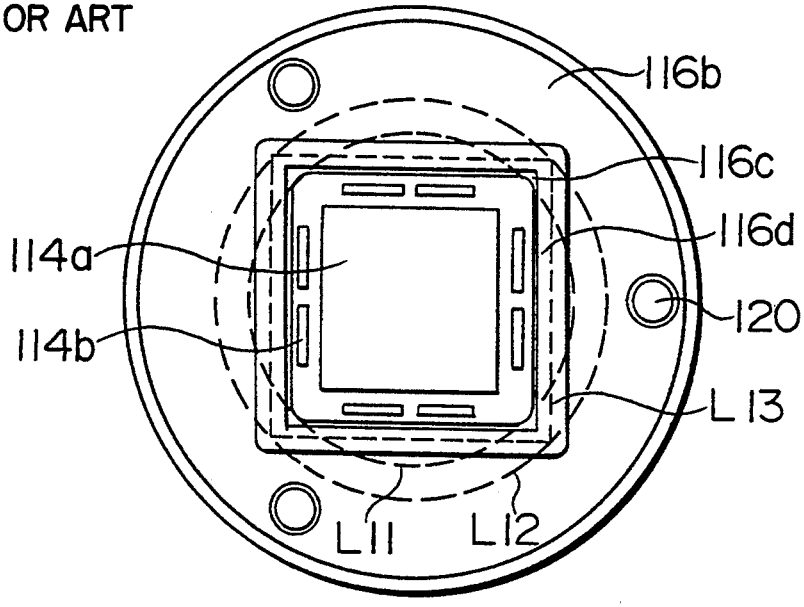
FIG. 4 PRIOR ART
FIG. 4 is a bottom plane view of FIG. 3.
Figure 7:
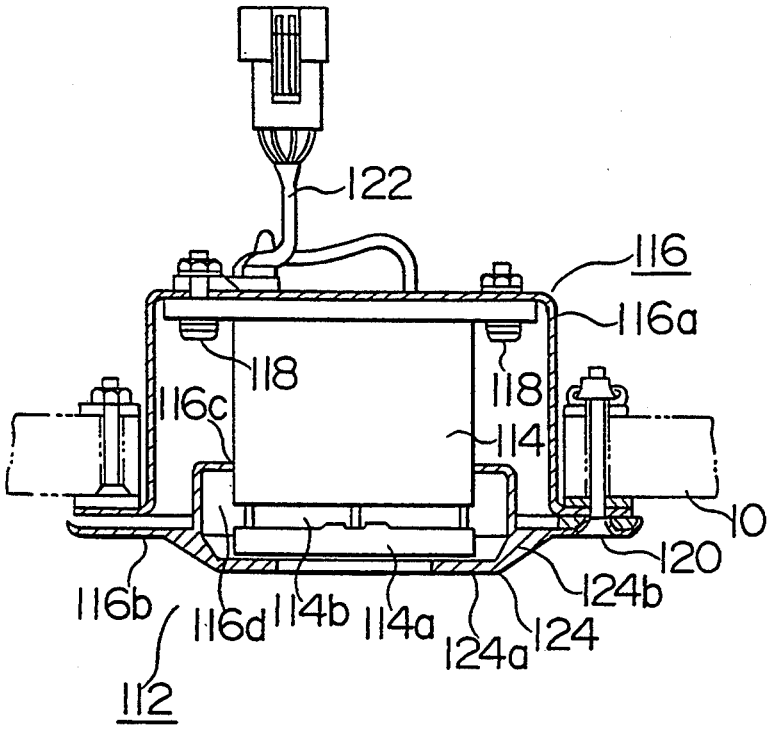
FIG. 7 is a vertical sectional view showing the fire detector according to another embodiment of the present invention, having countermeasures against tampering of the fire detector shown in FIGS. 3 and 4.
Figure 8:
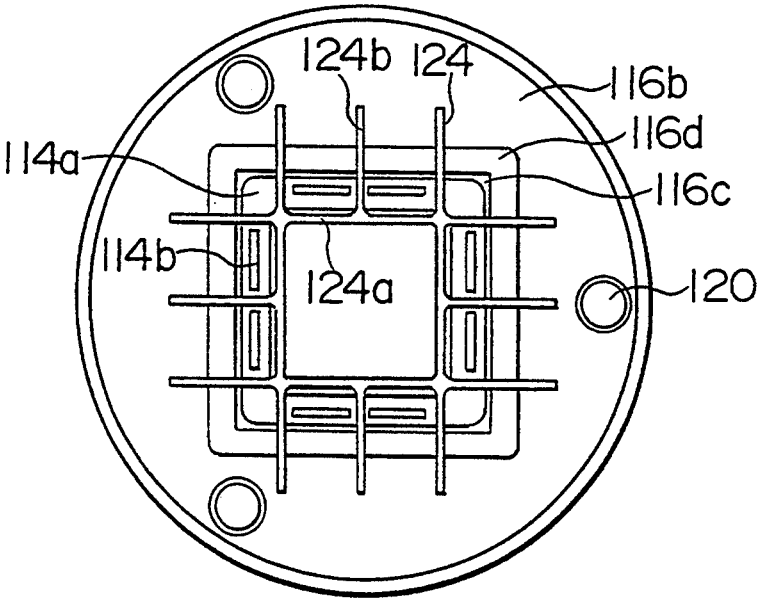
FIG. 8 is a bottom plane view of FIG. 7.

The countermeasure considered for the fire detector 112 shown in FIGS. 3 and 4 is shown in FIGS. 7 and 8. In FIGS. 7 and 8, as the same numerals are used for like parts shown in FIGS. 3 and 4, the explanation thereof is omitted. This countermeasure shown in FIGS. 7 and 8 is generally similar to the one shown in FIGS. 5 and 6. The surface portion 116b of the mounting portion 116 has a fin arrangement 124 formed integrally thereto. The fin arrangement 124 has a structure such that a portion thereof overlies the head portion 114a of the main body 114 as shown in FIG. 8 when the surface portion 116b of the mounting portion 116 is attached to the mounting portion 116 by screws 120 after the main body 114 is mounted to the receiving portion 116a of the mounting portion 116.

Similar to the case of FIG. 5, as seen from FIG. 8, the fin arrangement 124 includes a portion 124a higher than the head portion 114a that overlies the head portion 114a and spreading portions 124b gradually decreasing in height from the overlying portion 124a higher than the head portion 114a. The existance of the overlying portion 124a makes it impossible to mount a small-mouthed type paper cup on the head portion 114a, while the spreading portions 124b extend long enough beyond the mouth edge of normal type large-mouthed paper cups to make it impossible to mount such paper cups on the ends of the spreading portions 124*b* remote from the head portion 114*a*. Also, the constitution shown in FIGS. 7 and 8 makes it very difficult to stick chewing gum, tissue paper, vinyl bags, etc. as well as paper cups, on the inlet portions 114*b* and stepped portion 116*d* because the fin arrangement 124 disturbs such mischief.

Although the surface portions 16*b* and 116*b* of the mounting portions 16 and 116 having the fin arrangements 24 and 124, respectively, formed integrally thereto, are shown above as preferred embodiments, it is also possible to attach the fin arrangement 24 or 124 respectively to the surface portion 16*b* or 116*b* at a later date by adhesives or strongly adhesive double coated tape, etc. Further, as explained in later embodiments, it is also possible to fixedly attach the fin arrangement 24, 124 to the surface portion 16*b*, 116*b* by providing protrusions on the bottom surface of each of the fins of the fin arrangement. Then, by providing holes on the surface portion of the mounting portion for inserting the protrusions and by providing holding means in each hole for holding the protrusions, the fin arrangement can be attached and prevented from being easily extracted.

Still, even though the fin arrangements 24 and 124 provided with the overlying portions 24*a* and 124*a* partially overlying the head portions 14*a* and 114*a* of the main bodies 14 and 114 have been shown above, such overlying portions 24*a* and 124*a* can be omitted. In this case, when the overlying portion 24*a*, 124*a*, is omitted, the height of the high portion of the fin arrangement 24, 124, namely the height of each of the fins of the fin arrangement 24, 124 adjacent to the head portion 14*a* and 114*a* may be approximately equal to that of the head portion 14*a* and 114*a* protruding from the surface portion 16*b* and 116*b* of the mounting portion 16 and 116.

Figure 9:
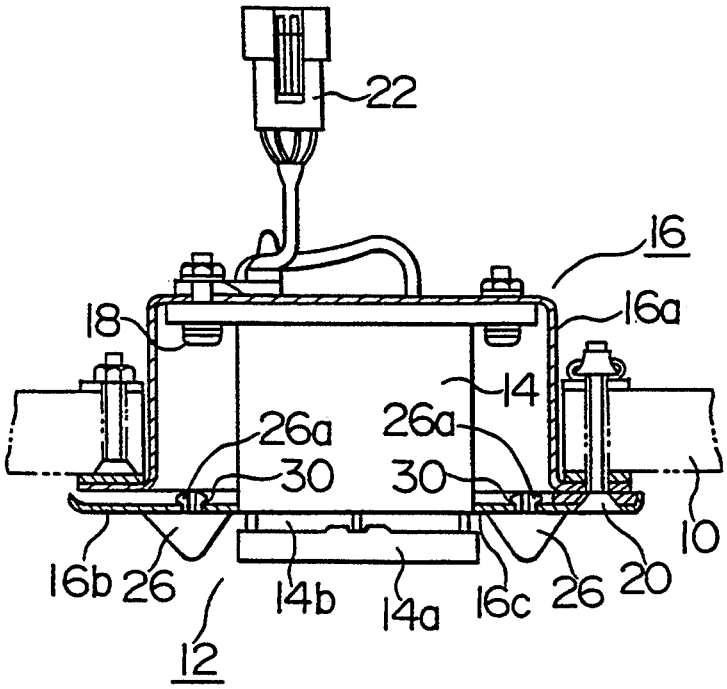
FIG. 9 is a vertical sectional view showing the fire detector according to yet another embodiment of the present invention, having countermeasures against tampering of the fire detector shown in FIGS. 1 and 2.
Figure 10:
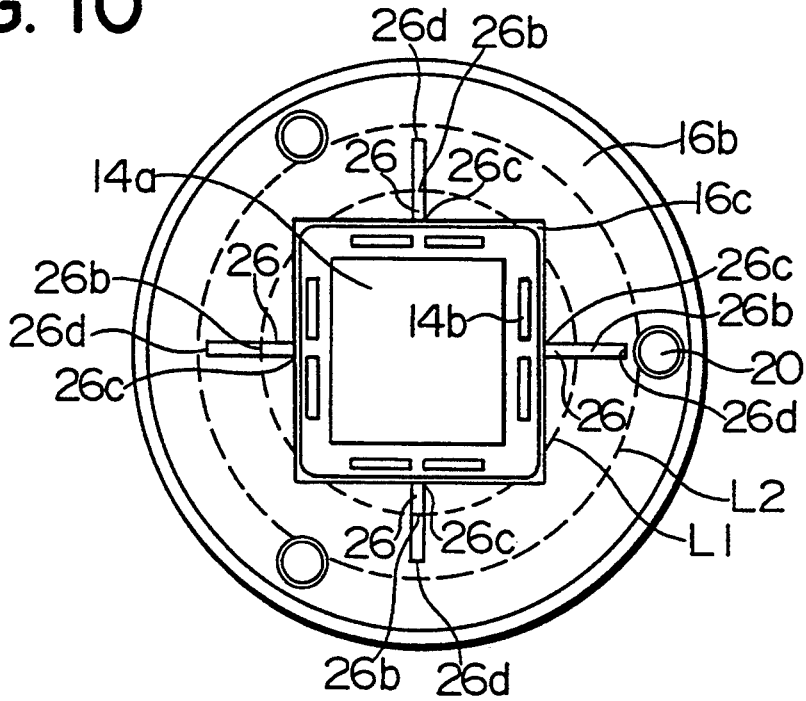
FIG. 10 is a bottom plane view of FIG. 9.

FIGS. 9 and 10 show the fire detector according to a further embodiment of the present invention, adopting another countermeasure for the fire detector shown in FIGS. 1 and 2, that differs from the measure explained in FIGS. 5 and 6. As mentioned in the explanation of FIGS. 5 and 6, the same numerals are used for like parts shown in FIGS. 1 and 2. The surface portion 16*b* of the mounting portion 16 of the fire detector 12 has four mounting holes 30 pierced around the central opening portion 16*c*. Generally triangular or semicircular plate members 26 are mounted as fins into these four mounting holes 30.

Figure 11A:
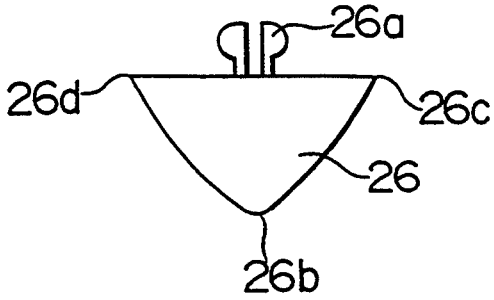
FIGS. 11A–11B are views showing in detail a plate member 26 shown in FIGS. 9 and 10.
Figure 11B:
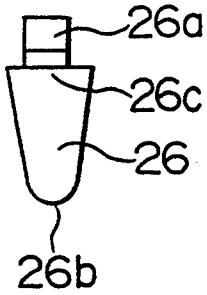

A plate member 26 is shown in detail in FIGS. 11A–11B. In FIG. 11A, is a front view of the plate member 26 and FIG. 11B is a side view seen from the right side of FIG. 11A. The plate member 26 is provided at the bottom surface thereof with a protrusion 26*a* inserted into one of the mounting holes 30. When the plate member 26 is placed at a right angle to one side adjacent to one of the mounting holes 30 among four sides of the quadrate main body head portion 14*a* and the protrusion 26*a* of the plate member 26 is inserted into the mounting hole 30 of the surface portion 16*b* of the mounting portions 16, the protrusion 26*a* engages with the mounting hole 30, thereby fixing the plate member 26 to the surface portion 16*b* of the mounting portion 16 so that it cannot be easily removed.

The shape and dimensions of the plate member 26 are such that, as shown in FIG. 10, the leading edge portion 26*c* (an end portion adjacent to the head portion 14*a*) of the base of the triangle or semicircle is closely adjacent to or in contact with the head portion 14*a* and that the vertex or top point 26*b* of the triangle or semicircle of the plate member 26 would contact with the mouth edge of a small-mouthed type paper cup, as shown by a dotted line L1, if someone mischievous tries to put such a paper cup on the head portion 14*a*. Further, if one tries to put a large-mouthed paper cup on the head portion 14*a* represented in FIG. 10 by a dotted line L2, the trailing edge portion 26*d* (an end portion opposite to the leading edge portion 26*c*) of the plate member 26 is within the dotted line L2 so that the mouth edge of a large-mouthed type paper cup will not engage with the plate members 26.

Figure 12A:
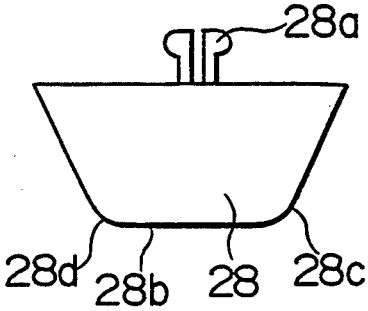
FIGS. 12A–12B are views showing another embodiment of a plate member.
Figure 12B:
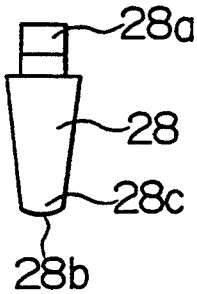

FIGS. 12A–12B show another embodiment of a plate member in which a plate member 28 used as a fin is in the form of a trapezoid. The shape and dimensions of the plate member 28 are preferably arranged so that, when the plate member 28 is mounted, the mouth edge of a small-mouthed type paper cup will contact with a corner 28*c* of the trapezoid as shown by a dotted line L1 in FIG. 13 and the mouth edge of a large-mouthed type paper cup will not extend past the upper side 28*b* of the trapezoid as shown by a dotted line L2.

Although it is shown that each plate member 26 or 28 is provided respectively with one protrusion 26*a* or 28*a* in FIGS. 11A–11B and 12A–12B, it is also possible to prepare a plate member 26 or 28 that is provided with two protrusions and the surface portion 16*b* of the mounting portion 16 with two mounting holes provided at two positions corresponding to the two protrusions of the plate member. In this way the plate member 26 or 28 can be fixed to the surface portion 16*b* of the mounting portion 16 at the two positions.

Figure 13:
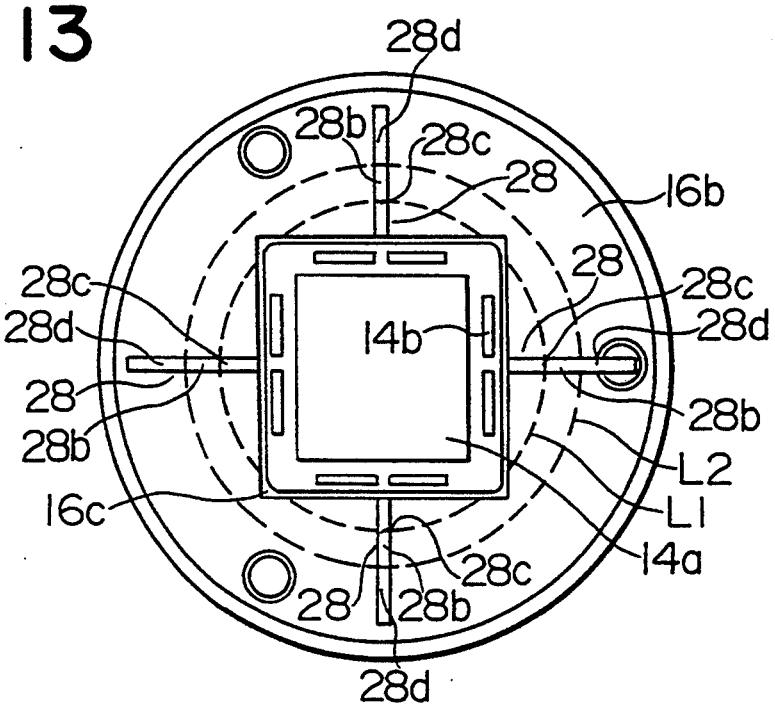
FIG. 13 is a bottom plane view showing the fire detector mounted with the plate member shown in FIG. 12.

As seen from FIGS. 9 and 13, a small-mouthed type paper cup can not be mounted on the head portion 14*a* of the main body 14 because of the obstruction of the vertex or the top point 26*b* of the plate member 26 when using the semicircular or triangular plate member 26, and because of the obstruction of the corner 28*c* of the upper side of the plate member 28 when using the plate member 28 in the form of a trapezoid. On the other hand, large-mouthed type paper cups can not be mounted on the head portion 14*a* because there is no surface such as an edge for the paper cup to be hooked on when using the plate member 26, and because the upper side 28*b* of the plate member 28 blocks the insertion of the cup when using the plate member 28.

Further, according to the constitution shown in FIGS. 9 and 13, the plate member obstructs the placing of tissue paper or vinyl bags, etc., on the inlet portions 14*b*, so that it is impossible to completely cover those inlet portions 14*b*.

Also, as the fire detectors shown in FIGS. 9 and 13 are so configured that the mounting of the plate members is performed by inserting them into the mounting holes of the mounting portion, the plate members can also be removed from the mounting portion when they are not needed.

Further, the plate members can be easily mounted on the surface portion 16*b* of the mounting portion 16 of already installed fire detectors by opening the desired number of mounting holes on the surface portion 16*b* around the central opening portion 16*c*.

Alternatively, the surface portion 16*b* of the mounting portion 16 may be provided integrally with the plate members 26 and 28 formed as the fins.

Figure 14:
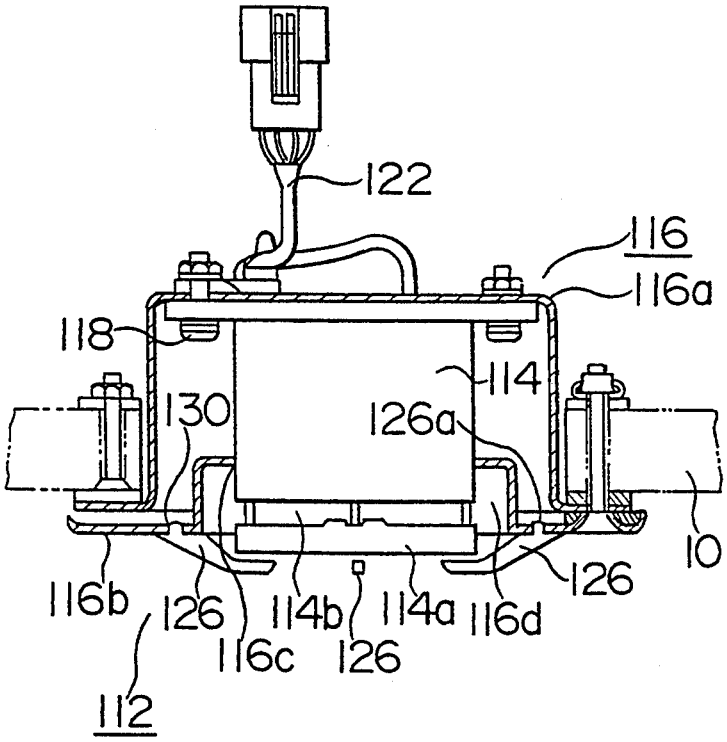
FIG. 14 is a vertical sectional view showing the fire detector according to a further embodiment of the present invention, having countermeasures against tampering of the fire detector shown in FIGS. 3 and 4.
Figure 15:
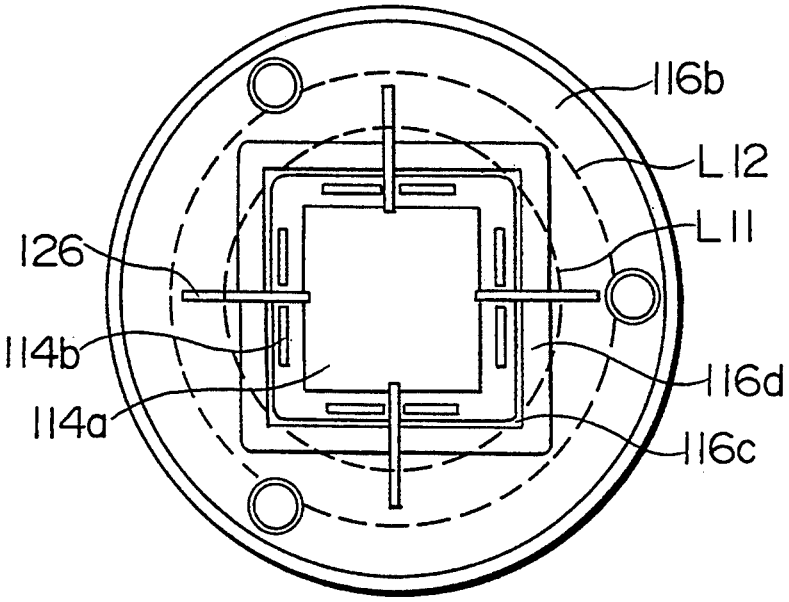
FIG. 15 is a bottom plane view of FIG. 14.

Another countermeasure considered for the fire detector 112 shown in FIGS. 3 and 4 differing from the measure explained in FIGS. 7 and 8 is shown in FIGS. 14 and 15. As mentioned in the explanation of FIGS. 7 and 8, the same numerals are used for like parts shown in FIGS. 3 and 4, so the explanation thereof have been omitted. In the embodiment shown in FIGS. 14 and 15, plate members 126 which partially ride on the head portion 114*a* and which gradually decrease in height therefrom are adhered to the surface portion 116*b* of the mounting portion 116 by adhesives, etc. The base of the plate members 126 are provided with protrusions 126*a* for engagement. Holes 130 for inserting the protrusions 126*a* are opened on the surface portion 116*b* of the mounting portion 116. The plate members 126 are adhered to the surface portion 116*b* by adhesives after the protrusions 126*a* of the plate members 126 are engaged with the holes 130.

As shown by a dotted line L11 in FIG. 15, the plate members 126 obstruct the mounting of the small-mouthed type paper cups on the head portion 114*a*. Also, as the plate members 126 do not extend beyond a dotted line L12 showing the mouth edge of large-mouthed type paper cups, it is impossible to engage the mouth edge of large-mouthed type paper cups with the ends of the plate members 126 remote from the head portion 114*a*, so that any tampering can be prevented. Further, the existence of the plate members 126 makes it very difficult to stick chewing gum, tissue paper, vinyls, etc., as well as paper cups in the inlet portions 114*b* and the stepped portion 116*d*.

Still, the arrangement and structure for each of the fins (each of the plate members) 24, 26, 124 and 126 are devised so that any smoke that rises upwardly and creeps along the ceiling surface can easily flow laterally into the inlet portions 14*b* and 11 4*b* of the fire detectors, namely so that smoke gathering efficiency can be enhanced, and are also further devised so that the direct inflow of upwardly rising smoke into the inlet portion 114*b* is not obstructed.

As described above, in accordance with the present invention, in a fire detector comprising a main body having a head portion for letting in combustion products and a fire detection portion performing fire detection on the basis of the combustion products let in from said head portion, and a mounting portion receiving most of the main body and provided with a central opening portion for allowing the head portion to protrude in order to perform fire monitoring, the fire detector further comprises an anti-tampering measure around the central opening portion of the mounting portion for preventing paper cups, etc., from being mounted on the head portion of the fire detector, thereby having the effect of making it difficult to reach the head portion of the main body to deter any tampering with the head portion.

While the embodiments of the present invention, as herein disclosed, constitute preferred forms, it is to be understood that other forms might also be adopted.

What we claim is:

1. A fire detector for use in a vehicle such as an aircraft comprising: a main body having a head portion for letting in products of combustion and a fire detection portion for performing fire detection in response to the products of combustion let in from said head portion; and a mounting portion receiving most of said main body and provided with a central opening portion for allowing said head portion to protrude in order to perform fire monitoring; wherein said fire detector further comprises blocking means around said central opening portion of said mounting portion for preventing articles, including paper cups, wherein there are normally provided on said vehicle, small-mouth type paper cups and one or more standard sizes of paper cups having mouths larger than said small-mouth type paper cups, from being mounted on said head portion of said fire detector, said blocking means having a height approximately equal to or higher than that of said head portion protruding from said central opening portion, the height thereof decreasing with distance away from said head portion.

2. A fire detector as recited in claim 1, wherein said head portion of said main body has a surface shape generally in the form of a square, the diagonal of said square being approximately the same size as the inside diameter of the mouth portion of a small-mouth type paper cup.

3. A fire detector as recited in claim 1, wherein said mounting portion includes a receiving portion for receiving most of said main body and a surface portion having said central opening portion.

4. A fire detector as recited in claim 3, wherein said surface portion is provided with a stepped portion in the periphery of said central opening portion to form a space around said main body for letting in the products of combustion.

5. A fire detector as recited in claim 2, wherein said mounting portion includes a receiving portion for receiving most of said main body and a surface portion having said central opening portion.

6. A fire detector as recited in any one of claim 4 or 5, wherein said blocking means are formed integrally with said mounting portion.

7. A fire detector as recited in any one of claims 4 or 5, wherein said mounting portion is provided with a plurality of mounting holes around said central opening portion thereof and said blocking means are removably mounted into said plurality of mounting holes.

8. A fire detector as recited in any one of claim 1 to 5, wherein said blocking means includes a plurality of fins provided around said central opening portion of said mounting portion.

9. A fire detector as recited in claim 8, wherein each of said fins comprises a high portion having a height equal to or greater than that of said head portion of said main body protruding from said central opening portion and a spreading portion gradually decreasing in height with distance away from said main body.

10. A fire detector as recited in claim 9, wherein said high portions of said fins are formed to be higher than the height of said head portion of said main body protruding from said central opening portion and to partially overlie the upper surface of said head portion.

11. A fire detector as recited in claim 8, wherein each of said fins is a plate-like member in a triangular, trapezoidal or semicircular shape with a central top portion and downwardly sloping portions at both sides of said top portion.

12. A fire detector as recited in claim 11, wherein said fins of said plate-like members are provided in said mounting portion so that the opening edge of said small-mouthed type paper cups contact with said top portions to prevent the mounting of small-mouth type paper cups on said main body.

13. A fire detector as recited in claim 9, wherein each of said fins is a plate-like member in a triangular, trapezoidal or semicircular shape with a central top portion and downwardly sloping portions at both sides of said top portion.

14. A fire detector as recited in claim 13, wherein said fins of said plate-like members are provided in said mounting portion so that the opening edge of said small-mouthed type paper cups contact with said top portions to prevent the mounting of small-mouth type paper cups on said main body.

15. A fire detector as recited in claim 2, wherein said blocking means includes a plurality of fins provided around said central opening portion of said mounting portion, each fin comprising a high portion having a height equal to or greater than said head portion of said main body protruding from said central opening and a spreading portion gradually decreasing in height with distance away from said main body, and wherein said spreading portions of said fins extend from said high portions to ends remote from said main body, and have lengths such that ends do not coincide with the inside diameter of the mouth edge of any of the normally provided standard size paper cups having mouths larger than said small mouth type paper cups.

16. A fire detector as recited in claim 15, wherein said high portions of said fins are formed to be higher than the height of said head portion of said main body protruding from said surface portion and to partially overlie the upper surface of said head portion.

* * * * *